United States Patent [19]

Ubukata et al.

[11] Patent Number: 4,510,481

[45] Date of Patent: Apr. 9, 1985

[54] SNAP ACTION TYPE THERMALLY RESPONSIVE SWITCHING STRUCTURE

[75] Inventors: Susumu Ubukata, 549-banchi, Nakasuna-cho, Tempaku-ku, Nagoya; Yasukazu Mizutani, Nagoya; Syozo Iyoda, Nagoya, all of Japan

[73] Assignee: Susumu Ubukata, Nagoya, Japan

[21] Appl. No.: 536,999

[22] Filed: Sep. 29, 1983

[30] Foreign Application Priority Data

Oct. 12, 1982 [JP] Japan ..... 57-178628

[51] Int. Cl.[3] ..... H01H 37/20

[52] U.S. Cl. ..... 337/368; 337/57; 337/347

[58] Field of Search ..... 337/57, 82, 93, 94, 337/347, 360, 368, 374, 375, 378

[56] References Cited

U.S. PATENT DOCUMENTS 3,587,022 6/1971 Hire ..... 337/368

*Primary Examiner*—Harold Broome

*Attorney, Agent, or Firm*—Steele, Gould & Fried

[57] ABSTRACT

A snap action type thermally responsive switch comprising a fixed contact secured to a stationary frame, a rectangular thermally responsive plate having a central dish-shaped portion and being secured at one lengthwise end to the stationary frame and carrying a movable contact, the plate being determined at the ratio of length to width to be more than two, a calibrator screw projecting toward the convex side of the dish-shaped portion to depress thereagainst at the normal temperature, the calibrator means being positioned to contact the dish-shaped portion within the region ranging from the central point to a point away from the central point that is equal to one-third of the width of the plate in the direction toward the secured end thereof.

5 Claims, 5 Drawing Figures

SNAP ACTION TYPE THERMALLY RESPONSIVE SWITCHING STRUCTURE

BACKGROUND OF THE INVENTION (1) Field of the Art

This invention relates to a switching structure having a thermally responsive element made from material such as bimetallic plate, trimetallic plate or the like with a dish-shaped portion formed at the central area, and more particularly concerns a switching structure in which the thermally responsive element is cantilever supported to reverse the inside out and move back with snap action in response to the ambient temperatures for making and breaking contact between movable and fixed contacts.

(2) Description of the Prior Art

In a thermally responsive switching structure of this type there is often employed a snap action thermally responsive relay device. A thermally responsive element comprising a rectangular bimetallic plate having a dish-shaped portion at the central area as seen at numeral 1 in FIG. 1 is employed. The plate 1 has one end rigidly secured to a connector iron 2 by means of welding or the like as seen at the cross mask in FIG. 1. The other end carries a movable contact 3 made from suitable material such as, for example, silver-based alloy.

Such is the construction that the plate 1 reverses with snap action to turn its full lined curvature into the broken lined one when the ambient temperature is elevated to reach, for example, 125° C., and moves back to the full lined original position when the ambient temperature decreases, for example to 80° C.

This is in detail seen at the graph of temperature characteristics in FIG. 3 which shows how the movable contact 3 displaces its specified point (referred to a portion depicted at C) as the ambient temperature rises, employing the axis of ordinates as displacement D of the portion C, while the axis of abscissas as temperature T on the assumption that the plate 1 has its connector iron 2 affixed to a stationary member such as, for example, a frame by a suitable means.

As the ambient temperature rises from the normal temperature $T_0$, the thermally responsive plate 1 gradually moves at its outer periphery with its curvature remaining unchanged for the time being (this motion is termed as "creeping" hereinafter).

With its creeping movement, the plate 1, of course, displaces its portion C from the reference position $D_0$ to the position $D_2$ along the characteristic curve A. However, the curvature is reversed with snap action to move the portion C from the position $D_2$ to the position $D_6$ at the temperature of $T_3$ such as, for example, 125° C.

Upon the application of temperature of above $T_3$, the plate 1 creeps to increase the displacement of the portion C, however, no further development in regard to the displacement of the portion C is suggested since it has no direct connection with how the thermally responsive relay device works.

With the decrease of the temperature, the thermally responsive plate 1 creeps to displace the portion C along the characteristic curve B toward the position $D_4$, and moves back to reverse the curvature into the original position so as to displace the portion C from the position $D_4$ of the curve B to the position $D_1$ of the curve A at the temperature of $T_1$ such as, for example, 80° C. Further temperature decrease from $T_1$ to $T_0$ functions to return the portion C to the reference position $D_0$ along the curve A.

The plate 1 displaces with respect to the temperature in a manner thus far described, however, we depict the negative characteristic curve represented by dotted line connecting the curve A at temperature $T_3$ and the curve B at temperature $T_1$ which is conveniently termed "unstable region" at the temperature ranging from $T_1$ to $T_3$.

In so doing, a support blade 6*a* is arranged to have its fixed contact 6 brought into engagement with the movable contact 3 to exert pressure in the direction of the curvature at the normal temperature as seen in FIG. 2. This makes it possible for the plate to snap at the temperature $T_2$, for example, 120° C. without permitting the plate to substantially creep.

To in detail mention the above structure, the plate 1 has the connector iron 2 secured to the horizontal half 4*a* of an L-shaped frame 4, and the support blade 6*a* has its one end secured through electrically insulated materials to the vertical half 4*b* of the frame 4 to form a cantilever support construction as well known for those versed in the art.

This is accounted that the thermally responsive plate 1 snaps to displace the portion C from the position $D_3$ to the position $D_5$ each time when the temperature rises from $T_0$ to reach to $T_2$ since the portion C is normally biased to occupy the position $D_3$ by the forcible engagement of the fixed contact 6 against the movable contact 3.

In this instance, the engagement between the fixed contact 6 and the movable contact 3 is maintained until immediately before the plate 1 snaps, thus preventing the contact 3 from chattering upon breaking contact between the former and the latter.

With the decrease of the temperature, the plate 1 creeps along the curve B to occupy the position $D_4$ at somewhat short of $T_1$, and moves back with snap action at $T_1$ to displace the portion C from the position $D_4$ to the position $D_3$ for making contact between the contacts 3 and 6.

It is of importance to suggest that the point gap between the contacts 3 and 6 immediately before the plate snaps at $T_1$ is the minimum available distance equivalent to the difference between the positions $D_4$ and $D_3$, while the similar point gap is equivalent to the difference between the positions $D_1$ and $D_4$ in those instances where the plate is in free condition with no bias toward the movable contact 3 presented.

It is in general that industrial part components are acceptable as long as they are within a certain tolerance range, so some thermally responsive plates have temperature characteristics as indicated at Ah, Nh and Bh in FIG. 3 deviated from the precedent one among a multitude of thermally responsive plates. Temperature calibration is such that the plate which has the above temperature characteristics makes the portion C position at $D_{3h}$ as seen from the curve Nh when the plate is on the point of snapping at $T_2$.

On the other hand, with the decrease of the temperature, the plate creeps along the curve Bh to displace the portion C from the position $D_{5h}$ to the position $D_{4h}$ at the temperature $T_{1h}$, thus rendering the point gap to be equivalent to so small a difference between the positions $D_{4h}$ and $D_{3h}$.

That is to say, if the plate is calibrated at the snap temperature by selecting the position of the movable contact from the characteristics of displacement D vs. temperature T, the possibility that the point gap when the plate is about to move back becomes unacceptably small.

Take, for example, a thermally responsive plate of 7 mm in width and 12 mm in length, although the dimension of both displacement D and temperature T are exaggerated for clarity in FIG. 3.

The point gap which is equivalent to the difference between the displacements $D_{4h}$ and $D_{3h}$ is diadvantageously less than 0.1 mm in contrast to the instance in which the point gap resulted from the difference between the displacements $D_4$ and $D_3$ is relevantly around 0.3 mm. In consequence, the isolating voltage between the contacts reduces to such an extent that the plate moves back accompanied by chattering at the contact with the decrease of the temperature, thus rendering unacceptable to incorporate it with a relay device.

One of the problems caused by the above situation results in a low yield rate upon manufacturing product due to a tight tolerance restriction that each thermally responsive plate must have characteristics extremely close to that represented at A, N and B among a multitude of similar plates prepared.

SUMMARY OF THE INVENTION

It is therefore a primary object of the present invention to provide a novel thermally responsive switching structure which will be particularly effective in obviating precedent drawbacks of the prior art counterpart.

It is an object of the invention to provide a thermally responsive switching structure which is capable of preventing a point gap between movable and fixed contacts from significantly being reduced when a thermally responsive element is about to move back with the decrease of the temperature irrespective of snap temperature calibration at which the element snaps with the increase of the temperature.

It is another object of the invention to provide a thermally responsive switching structure which allows for an improved yielding rate by arranging inherent characteristics to alter upon temperature calibration under the circumstances where each element has each temperature characteristics within a certain tolerance range.

It is still another object of the invention to provide a thermally responsive switching structure which is capable of preventing a thermally responsive element from moving back at the temperature significantly deviated off a predetermined one irrespective of snap temperature calibration at which the element snaps with the increase of the temperature.

It is still further object of the invention to provide a thermally responsive switching structure in which under the circumstances where a thermally responsive element is of elongated rectangular shape and cantilever supported configuration, the element is resistant to bending prostration irrespective of an additional point pressure exerting between movable and fixed contacts upon calibrating snap temperature at which the element snaps with the increase of the temperature.

The above and other objects, features and advantages of the present invention will become apparent from the following description and the appended claim, taken in conjunction with the accompanying drawings which shows by way of example preferred embodiments of the present invention and in which like component parts are designated by like reference numerals throughout various figures.

BRIEF DESCRIPTION OF THE DRAWINGS

In the accompanying drawings.

DETAILED DESCRIPTION OF THE PREFERRED EMBODIMENT

Figure 4:
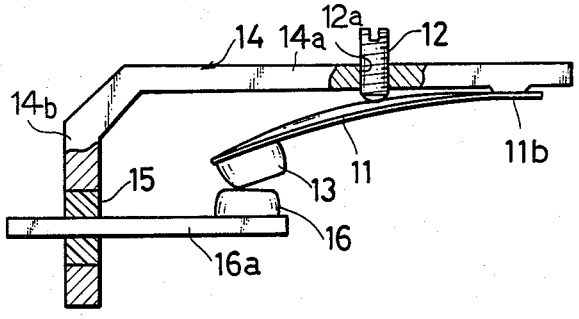
FIG. 4 is a side elevational view embodying a thermally responsive switching structure according to the invention, but partly in section.
Figure 5:
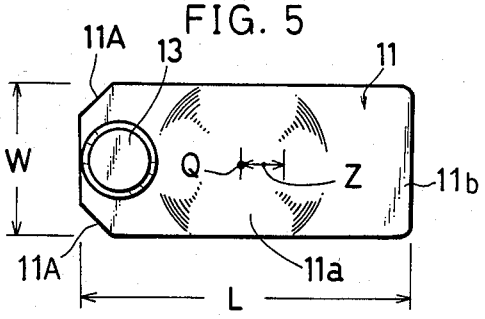
FIG. 5 is a plan view looking at the thermal responsive element in FIG. 4 from below.

Referring to FIGS. 4 and 5, a rectangular thermally responsive plate, designated 11, is formed from laminated bimetallic sheets by means such as, for example, stamping, one sheet of which is greater than the other in thermal expansion as well known for those skilled in art. The plate 11 is provided with a central circular dish-shaped portion 11*a* by means of drawing, the curvature of which is opposite to a later described movable contact at the normal temperature. The plate 11 thus formed is secured at one end to the horizontal half 14*a* of a L-shaped frame 14 by means of welding or the like at 11*b* to constitute a cantilever support. The plate 11 carries a movable contact 13 at the other free end positioned opposite to the cantilever support end 11*b*.

A support blade 16*a* is secured at one end to the vertical half 14*a* of the frame 14 through an electrically insulated filler 15, and carries a fixed contact 16 at the other end which corresponds to the movable contact 13.

A calibrator screw 12 is vertically movably threaded into a hole 12*a* provided with the horizontal half 14*a* of the frame 14 in position to have the lower end brought into engagement with the upwardly curved convex surface of the dish-shaped portion 11*a* at the normal temperature in the following manner.

That is, the thermally responsive plate 11 is determined the ratio of length L to width W to be two or more than two, while the calibrator screw 12 is positioned with its lower end at the dish-shaped portion within a region conveniently indicated at Z in FIG. 5. The region Z ranges from the center Q of the dish-shaped portion 11*a* to a point longitudinally displaced from the center Q toward the support end 11*b* for the reason readily revealed hereinafter.

In this situation, the support blade 16*a* is only needed to position its contact 16 at $D_1$ or $D_{1h}$ so as to substantially osculate the movable contact 13 with the screw 12 starting no influence upon the plate 11. Turning the screw 12 in a suitable direction moves the screw to push the plate 11 downward to provide a point pressure between the contacts 13 and 16 required for the plate 11 to snap at a predetermined temperature such as, for example, $T_2$ with the increase of the temperature.

The calibrator screw 12, in this way, pushes the dish-shaped portion 11*a* within the region Z to provide the point pressure with the fixed contact 16 positioning at $D_1$ or $D_{1h}$ upon calibrating the snap temperature unlike the prior art structure which forcibly displaces the movable contact to position at $D_3$ or $D_{3h}$ by locating the fixed contact the same.

The structure thus far described according to the invention makes it possible to calibrate the snap temperature, because the dish-shaped portin 11*a* pushed by the screw 12 undergoes deformation to develop in its depth-reducing direction so as to alter the inherent temperature characteristics.

Altering the temperature characteristics prevents the point gap between the contacts from significantly being reduced when the plate is about to move back with the decrease of the temperature irrespective of the temperature calibration at which the plate snaps with the increase of the temperature under the circumstances where each plate has each temperature characteristics within a certain tolerance range as represented at the curves A-N-B and $A_h$-$N_h$-$B_h$. This permits a more generous tolerance, thus ensuring an improved yield rate upon manufacturing the product.

According to the present invention, a switching structure prevents the plate from moving back with the decrease of the temperature at a temperature significantly deviated from a predetermined one irrespective of the snap temperature calibration at which the plate snaps with the increase of the temperature. This functions to render the moving-back temperature generally immune to the temperature calibration.

Figure 1:
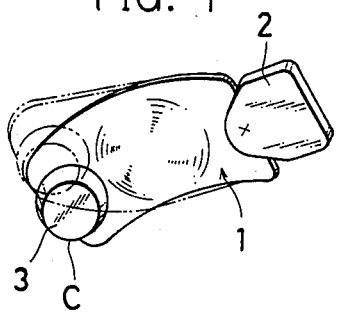
PRIOR ART FIG. 1
FIG. 1 is a perspective view of a prior art thermally responsive element shown together with a movable contact and a connector iron.
Figure 2:
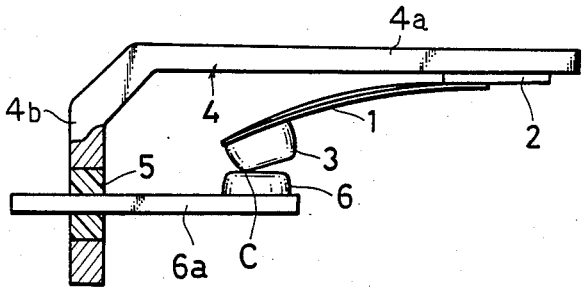
PRIOR ART FIG. 2
FIG. 2 is a side elevational view of a prior art thermally responsive switching structure, but partly in section.
Figure 3:
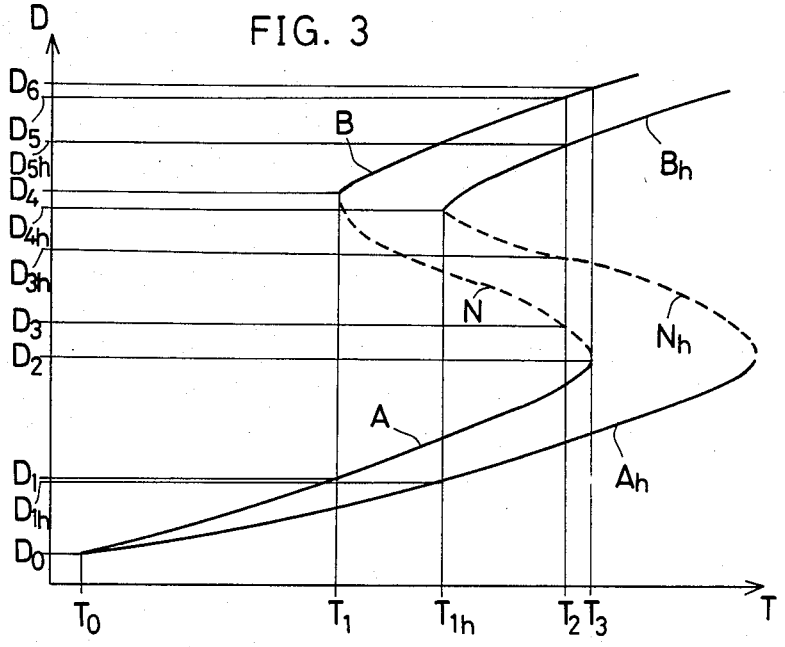
FIG. 3 is temperature characteristic graph showing how a thermally responsive element displaces with the temperature.

This is because the plate 11 effectuates the dish-shaped portion 11*a* to displace so as either to be away from the lower end of the screw 12 or to extremely reduce the contact pressure between the lower end of the screw 12 and the dish-shaped portion 11*a* albeit the portion 11*a* remains engaged with the screw 12, and thus substantially presents the inherent temperature characteristics as seen at the curves B or $B_h$ in FIG. 3 after the plate had snapped so as to break the movable contact 13 from the fixed contact 16 with the increase of the temperature.

In connection with the above, a series of experimentations are carried out to seek conditions in which the plate renders the moving-back temperature generally immune to the temperature calibration. For this purpose a suitable number of thermally responsive plates having thickness ranging from 0.1 mm to 0.25 mm were taken as test pieces.

As a result, it is found that the relationship which the plate has between its width W and length L, and the position in which the calibrator screw 12 occupies on the dish-shaped portion 11*a* have great influence on the moving-back temperature. Speaking in detail, the plates taken as test pieces were assorted into two groups; the first group of plates having the ratio of L/W from 1.7 to 1.9, with the second group of plates having the ratio of L/W from 2.1 to 2.7 in order to check erratic rate. The erratic rate thus termed here for convenience is expressed as $(\alpha-\beta/\beta)\times 100$, where $\alpha$ is the temperature at which a plate freed from the screw 12 independently moves back with the decrease of the temperature; $\beta$ is the temperature at which a plate calibrated by the screw 12 moves back.

In so doing, it was found that the erratic rate of the first group was from +7 percent to +15 percent, while that of the second group was from ±0 percent to +2 percent with the screw 12 positioned at the center Q of the dish-shaped portion 11*a*. By changing the position of the screw 12 against the dish-shaped portion 11*a* to be longitudinally away from the center Q toward the movable contact 13 by 10 percent of the width W, the erratic rate of the first group was between −10 percent to +20 percent, while that of the second group was from −2 percent to +6 percent. By still changing the position of the screw 12 to be longitudinally away from the center Q by 10 percent of the width W toward the support end 11*b* opposite to the contact 13, the erratic rate of the first group slightly decreased to be from +7 percent to +12 percent, while that of the second group was from ±0 percent to +1.5 percent.

By thus changing the position of the screw 12 against the dish-shaped portion 11*a* away from the center Q toward the support end 11*b*, we finally found that it is necessary for the screw 12 to be positioned within the region Z ranging from the center Q to the point longitudinally distanced from the center Q by ⅓W toward the support end 11*b* to keep the erratic rate sufficiently small to be ignorable. Note that the plate 11 has its corners in the proximity of the contact 13 bevelled as shown at 11A in FIG. 5, however, the plate is desired to be termed as yet rectangular in shape, because bevelling hardly affects on snap motion of the plate.

The plate, according to the invention, is preferably of rectangular in shape, and determined at the ratio of L/W to be two or more than two, however, the plate is resistant to bending prostration at the support end 11*b* like the prior art plate of which the ratio in connection with L/W is less than 1.7.

This is because the force directed from the movable contact to the fixed contact is resulted from the calibrator screw 12, not from the support end 11*b*.

It is appreciated that except for the expedience of micro-adjustment, the calibrator screw 12 may be replaced by a mere projection means which is adapted to depress the plate 11 at the specified portion.

While the form of the invention now preferred has been disclosed as required by statute, other forms may be used, all coming within the scope of the claimed subject matter which follows:

What is claimed is:

1. A snap action type thermally responsive switching structure comprising;

a fixed contact secured via a suitable support blade to a stationary means in electrically insulated relationship therewith;

a thermally responsive element which is formed into a generally rectangular shape with a substantially circular dish-shaped portion therein, the element being secured at one lengthwise end to said stationary means, and a movable contact carried at the other end to make and break contact against said fixed contact when snapped in response to the temperature, said thermally responsive element being determined by the ratio of its length to its width to be two or more than two; and a calibrator means provided with said stationary means to project toward the convex side of said dish-shaped portion so as to depress thereagainst at the normal temperature, said calibrator means being positioned to contact said dish-shaped portion within the region defined between its central point and a point spaced away from said central point in a lengthwise direction equal to one-third of the width of the said thermally responsive element toward the secured end thereof.

2. The structure of claim 1 wherein the calibrator means comprises a movable member, the member being movably secured in the stationary means and being movable toward and away from the said dish-shaped portion.

3. The structure of claim 2 wherein the movable member is threaded.

4. The structure of claim 1 wherein the structure has an erratic rate, the erratic rate being expressed as $(\alpha-\beta/\beta)\times 100$ and wherein the erratic rate is between $-2$ percent and $+6$ percent where $\alpha$ is the temperature at which the thermally responsive element freed from the calibrator means independently moves back upon a decrease in temperature, and $\beta$ is the temperature at which the thermally responsive element contacted by the calibrator means moves back upon a decrease in temperature.

5. The structure of claim 4 wherein the erratic rate is between $\pm 0$ percent and $+1.5$ percent.

* * * * *